United States Patent [19]

Hogue

[11] Patent Number: 4,941,383

[45] Date of Patent: Jul. 17, 1990

[54] METHOD FOR TUNING VIOLINS

[76] Inventor: John Hogue, 436 S. Saginaw St., Flint, Mich. 48502

[21] Appl. No.: 264,352

[22] Filed: Oct. 31, 1988

[51] Int. Cl.[5] ..... G10D 1/02

[52] U.S. Cl. ..... 84/275

[58] Field of Search ..... 84/274, 275, 291

[56] References Cited

U.S. PATENT DOCUMENTS

| | | | |
|---|---|---|---|
| 3,884,109 | 5/1975 | Johnson | 84/275 |
| 4,373,980 | 2/1983 | Skalmierski et al. | 84/275 X |
| 4,407,181 | 10/1983 | Thomas | 84/275 |

OTHER PUBLICATIONS

Hutchins, "The Acoustics of Violin Plates", Scientific American, vol. 245, No. 4, Oct. 1981, pp. 170–186.

*Primary Examiner*—Lawrence R. Franklin

*Attorney, Agent, or Firm*—Charles W. Chandler

[57] ABSTRACT

A process for testing stringed wooden instrument components during manufacture to improve and make uniform the component vibrational performance. The wooden component is tapped lightly to produce an audible vibrational response that is measured against a standard response. If necessary, material is removed from the component to enable the response to match the standard.

14 Claims, 1 Drawing Sheet

METHOD FOR TUNING VIOLINS

BACKGROUND OF THE INVENTION

Figure 1:
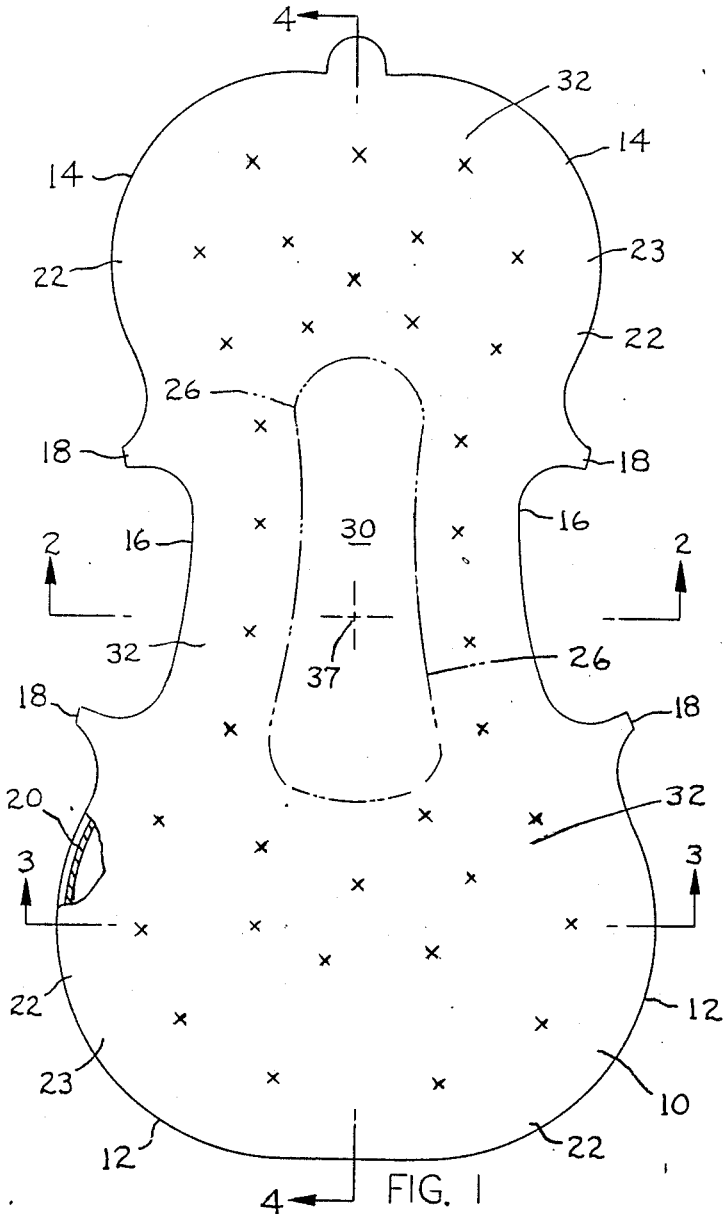

This invention relates to musical instruments, particularly stringed wooden instruments such as the violin, guitar, cello, piano sounding board, or bass viol.

My invention is usable during the manufacture of stringed wooden instruments (or bows used with stringed wooden instruments) to improve the tonal quality of the instruments (by increasing the resonance characteristics).

To facilitate discussion of my invention, I will describe it in connection with violins. It will become apparent that the invention is capable of being practiced with other musical instruments.

Violins usually comprise front plates, back plates and interconnecting side walls (sometimes termed ribs). The front plate and back plate are relatively thin wooden slabs having thicknesses ranging from about 0.10 inch near peripheral areas thereof to about 0.17 inch in central areas thereof. As the bow is drawn over the violin strings the string vibrations are transmitted through the associated bridge to the front plate and then to the back plate. Both plates are caused to vibrate, thereby compressing and expanding the air within the space enclosed by the plates so as to produce a musical note.

In order to enhance the resonance (vibrational) characteristics of the violin the violin maker sets relatively close tolerances on the front and back plate, whereby the peripheral areas of each plate are caused to flex in unison (together) so as to produce as great a deflection of the plate central area as possible.

As far as I know, the use of close tolerances is the principal means of controlling the tonal quality of violins. The assumption is that wood is a homogeneous uniform substance that will consistently perform in the same given manner if manufacturing tolerances are closely controlled.

SUMMARY OF THE INVENTION

In my work as a violin maker I have come to the conclusion that wood of a given tree species is not homogeneous or uniform. I have concluded that wood of a given species, e.g. maple, can vary in hardness, from place to place in a given piece of wood, or from one piece of wood to another. Soft areas in the wood tend to adversely affect the resilience of the wooden piece (e.g. a violin backplate).

Due to the inhomogeneity of wood (varying degrees of hardness), I have concluded that it is not possible to consistently achieve high tonal quality violins by relying solely on close tolerance control of the wood thickness (although such tolerance control is important).

My invention contemplates a method of violin manufacture wherein a nominally finished violin plate (back plate and/or front plate) is subjected to a series of tapping motions at selected points along the plate surface. While a given tapping motion is taking place the craftsman listens intently to the sound produced by the tapping motion. Depending on the resonating character of the wood at the point where the tapping action is taking place, the sound produced by the tapping will be higher or lower (taken on the musical scale).

In practice of the invention the craftsman selects a note, e.g. D on the musical scale, that he wishes to obtain by the tapping action. If the note actually obtained is higher than the selected note, the craftsman removes material from the plate surface at the area where the tapping is taking place. Hand sanding or power sanding is the preferred method of removing material, although a chisel or router could conceivably be employed.

The process of tapping (to obtain an audible indication of the material resonance characteristic) and material removal is repeated until the craftsman obtains the desired audible response for a given point on the wooden plate.

The process and tapping and removing material is carried out for a series of points on the plate, such that substantially all areas of the plate exhibit the same flexing characteristics (same audible response).

When my process is used to manufacture violins, the tonal quality of the violins will be relatively consistent, from one violin to the next, even though the wood may vary as to softness or unit thickness flexure response. Additionally, the tonal quality will be somewhat improved since the flexing portions of the plate will be in phase, so to speak, because of the more uniform response to the vibrational source (vibrating bridge).

My invention is applicable to the manufacture of the violin back plate as well as the violin front plate. The invention may also be applied to the manufacture of other musical vibrating components formed out of wood, e.g. violin side walls, violin bows, guitars, bass viols, piano sounding boards, etc.

THE DRAWINGS

Figure 4:
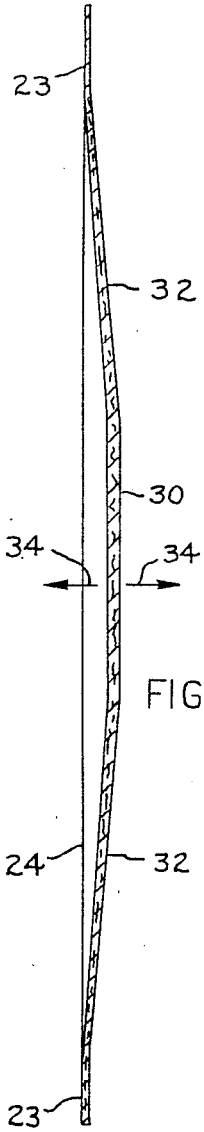
Figure 2:
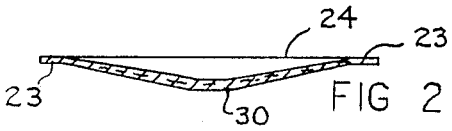
Figure 3:
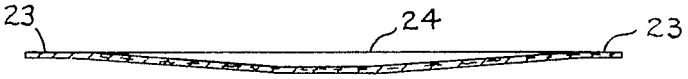

FIG. 1 is a plan view of a violin back plate that can be formed using my inventive process; and FIGS. 2, 3 and 4 are sectional views taken respectively on lines 2—2, 3—3 and 4—4 in FIG. 1.

DESCRIPTION OF A PREFERRED FORM OF MY INVENTION

FIGS. 1 through 4 illustrate a violin back plate 10 formed of wood to a predetermined configuration, wall thickness and curvature. The plate has a lower convexly curved edge 12, an upper convexly curved edge 14, and two central concave edges 16. The edges are reversely curved where they connect together so as to form four purflings 18.

The remaining parts of the violin are not shown in the drawing, except that in FIG. 1, I show a fragmentary section of a side wall (rib) 20 glued to the face of back plate 10 near its outer edge. The back plate and violin side wall may be of conventional contour and construction.

In the violin maker's trade the central plate area between the four purflings 18 is sometimes termed the middle bout. The plate area below the two lowermost purflings is sometimes termed the lower bout, and the plate area above the two uppermost purflings is sometimes termed the upper bout.

As will be apparent from FIGS. 2 through 4, the violin back plate is of dished construction. Peripheral rim area 22 defines an essentially flat surface 23 occupying a single plane designated by numeral 24. Surface 23 is flat for gluing the backplate to peripheral side wall (rib) 20.

FIG. 1 is a plan view looking at the upper (inside) face of the backplate. As seen in FIGS. 2 and 3, the lower (outer) face of the plate is convexly dished; the upper (inside) face is concavely dished. The wall thickness of the plate is not uniform. In general, the central bout (area circumscribed by purflings 18) is relatively thick, whereas the end areas are relatively thin. However, there is no abrupt change in wall thickness. Instead, there is a gradual change in wall thickness.

In FIG. 1, I have drawn an imaginary line 26 to indicate generally the demarcation between the central thicker plate area and the thinner peripheral plate area. The area 30 circumscribed by line 26 is relatively thick, i.e. up to about 0.17 inch, whereas the surrounding area 32 is thinner, about 0.10 inch. Line 26 represents approximately the transition zone between the thicker zone and thinner zone. Actually, the transition is not a line, but is instead much broader, as will be seen from FIGS. 2 through 4. FIG. 4 is taken through a so-called "thin" area of the plate. The plate thickness is essentially about 0.10 inch across the plate area.

When the back plate is assembled with other components to form a violin, the plate forms a vibratable diaphragm having the capability to vibrate in a direction normal to its general plane. Numeral 34 denotes the direction of plate vibration. Vibrational flexure is believed to take place primarily in the thinner plate areas 32. The central relatively thick plate area 30 is not believed to flex; instead it moves bodily as a unit under stresses imposed by flexure of peripheral plate areas 32. A sounding post (not shown) may be trained between central points on the back plate and the front plate to transmit vibrational forces from one plate to another.

It is believed that the vibrational amplitude and linear velocity may be enhanced by making all sections of flexible plate area 32 respond in phase to the vibrations source, such that all sections of the plate are working together in unison. If wood were a homogeneous material the desired response could be achieved by closely controlling the plate thickness, through mathematical calculations of the stress-strain relationships or through trial and error experimentation. However, I have concluded that variations in wood (principally hardness-softness variations) make it difficult to achieve a consistent flexure response. Soft areas in the wood tend to be less resilient than harder areas.

I propose to test the flexure response of the plate at various points along the wood surface, and to remove areas of the wood surface as will give the wooden plate a uniform flexure response over the entire plate surface. The flexure response test involves tapping the upper surface of the plate at a specific point thereon, while noting the audible sound (musical note) produced by the tapping action.

I have found that good results can be obtained by lightly tapping the plate surface with the knuckle on my first finger while my ear is within a few inches from the tapping point. A soft resonant vibrating musical sound is produced. The tone (note) is related to the vibrational frequency induced into the wood at the tapping point. I have found that it is possible to relate the sounds to the musical scale, and to select one sound as a standard.

I initially form the wooden slab so that the slab thickness is slightly greater than the thickness known to produce a desired resonant condition. I then begin testing by tapping the plate surface at a specific point thereon. If the audible response is higher (on the musical scale) than the desired response, then I remove material from the face of the wooden plate at the point where the tapping was carried out. Wood removal is best performed by sanding the plate surface. I repeat the tapping and wood removal steps until I get the desired audible response. I then go on to another point on the wooden plate and perform the same tapping-wood removal sequence to get the desired audible response at that point.

It may be necessary to perform the testing-wood removal procedure at several points along the plate surface. In FIG. 1, I show multiple test points with small x's. The number of test points is determined to some extent by the nature of the wood from which the back plate is formed. The uniformity (nonuniformity), as well as the general level of wood hardness, are factors bearing on the extent of testing required.

In practicing my invention, I perform the flexure tests at points spaced inward from the peripheral edges of the plate (because the plate edges are later glued to side walls 20, and hence are not movable parts of the flexure system). In general, I test the thinnest sections of the plate first and the thickest sections last, since I believe it is most essential to concentrate my efforts where flexure abnormalities are most critical. Preferably I test areas near the periphery of the plate first, and then gradually work toward the central axis 37 of the plate. The violin ribs are tuned to the backplate tone.

Although I have found that tapping with one's knuckle gives a recognizable vibrational response, other devices may be used, e.g. the erasure end of a pencil may be softly tapped against the wood surface to produce a vibrating response. The tapping device should be of a semi-resilient (soft) nature, as opposed to a hard metallic device, in order to minimize the impact noise that may tend to mask the vibrational sound.

Use of one's ear to detect the audible response requires musical training and practical experience. It is believed possible to substitute a microphone and oscilloscope for the person's ear. The microphone would be positioned near the tapping point to generate an electrical signal related to the vibrational response. The oscilloscope would pictorially depict the wave form on the oscilloscope screen. A given musical note exhibits a unique wave form on the oscilloscope screen.

The tapping test operation is performed with the violin plate held in the person's other (free) hand. Preferably the person's grip on the plate is relatively light and remote from the tapping point in order not to completely dampen the vibrational action. It would be possible to design a support fixture for the plate, in lieu of using the person's hand for support purposes.

My invention can be practiced before or after the violin plate is varnished. The sanding wood-removal operations are performed on the inner (unvarnished) surfaces of the plate.

The invention can be practiced in conjunction with the manufacture of other wooden stringed instruments. When it is used in conjunction with the manufacture of wooden violin bows, the tapping tests are performed at spaced points along the bow surface, beginning at the frog end of the bow and working toward the tip end.

Having described my invention, I claim:

1. A method of manufacturing and tuning a plate for a wooden violin comprising the steps of:

a. forming the plate to a predetermined plan configuration and curvature, having a relatively thinner outer periphery and a relatively thicker central axis portion, with an overall thickness slightly greater than the desired thickness of the tuned plate;

b. holding the plate in a manner to avoid completely dampening the vibrational action of the plate;

c. tapping the surface of the plate at a selected location remote from the holding location, starting at the relatively thinner sections near the outer periphery of the plate, to produce an audible sound;

d. controllably removing material in proximity to the tapping location where the audible sound is higher than the desired audible sound, thereby lowering the audible sound;

e. working inward from the outer periphery of the plate as the desired audible sound is produced, staring with the thinnest sections of the plate and gradually working towards the central axis portion of the plate where the thicker sections of the plate are located, to manufacture and tune a wooden violin plate to the desired audible sound.

2. The method of claim 1 wherein the tapping step is performed with a person's knuckle.

3. The method of claim 2 wherein the tapping step is performed with the person's hand gripping an edge area of the plate at a point remote from the tap point.

4. The method of claim 3 wherein the tapping step is performed with the person's ear in close proximity to the tap point.

5. The method of claim 1 wherein the step of removing material from the plate is performed on the inner face of the backplate.

6. The method of claim 1 wherein the step of removing material from the plate is performed by sanding the inner face of the backplate.

7. The method of claim 1 wherein steps c and d are performed first at points on the backplate designed for maximum flexure, and thereafter at points on the backplate designed for minimum flexure.

8. A method of manufacturing and tuning a violin having a back plate, a front plate, and rib means between the front plate and the back plate, comprising the steps of:

a. forming a wooden back plate, a wooden front plate, and wooden rib means according to a predetermined plan configuration and curvature, with a thickness slightly greater than the desired thickness of the back plate, the front plate and the rib means;

b. holding one of said front plate, back plate, or rib means in a manner to avoid completely dampening the vibrational action of said one of said front plate, back plate, or rib means;

c. tapping the formed front plate at a selected location to produce a vibrational movement and audible sound;

d. removing material in proximity to each tapping point, when the audible sound is higher than the desired audible sound, and gradually working inward from the outer periphery of the front plate to achieve the desired audible sound;

e. tapping the formed back plate at a selected location, starting with the relatively thinner portions of the back plate;

f. controllably removing material from the back plate in proximity to the tapping location where the audible sound is higher than the desired audible sound, thereby lowering the audible sound as material is removed, and working towards the central axis of the back plate until the desired audible sound is achieved;

g. tapping the rib means at a selected location, to produce an audible sound; and selectively removing material from the rib means in proximity the tapping location, to lower the audible sound.

9. A method of manufacturing and tuning a sounding board from a stringed musical instrument comprising the steps of:

a. forming a wooden sounding board to a predetermined plan configuration and curvature, with an overall thickness slightly greater than the desired thickness of the tuned sounding board;

b. holding the sounding board in a manner to avoid completely dampening the vibrational action of the plate;

c. tapping the sounding board at a selected location thereon to produce an audible sound;

d. selectively removing material from the sounding board in proximity to the tapping point, to lower the audible sound; and e. working from the outer periphery of the sounding board towards the central axis by selectively removing material from the sounding board at each tapping location until the desired audible sound is produced at each tapping location.

10. The method of claim 9 wherein the tapping step is performed with a person's knuckle.

11. The method of claim 10 wherein the tapping step is performed with the person's hand gripping an edge area of the sounding board at a point remote from the tap point.

12. The method of claim 11 wherein the tapping step is performed with the person's ear in close proximity to the tap point.

13. The method of claim 9 wherein the step of removing material from the sounding board is performed by sanding one face of said board.

14. The method of claim 9 wherein steps c and d are performed first at points on the sounding board designed for maximum flexure, and thereafter at points on the board designed for minimum flexure.

* * * * *